US006325263B1

(12) United States Patent
De Dompierre et al.

(10) Patent No.: US 6,325,263 B1
(45) Date of Patent: Dec. 4, 2001

(54) MOVABLE TOOL FOR SEPARATING BLANKS FROM A SHEET OF DIE-CUT BLANKS

(76) Inventors: Jean-Bernard De Dompierre, Chemin de la Graviere 2, CH 1026 Echandens (CH); Ulrich Schwager, Im Freudenspiel 82, D79790 Kadelburg (DE)

( * ) Notice: Subject to any disclaimer, the term of this patent is extended or adjusted under 35 U.S.C. 154(b) by 569 days.

(21) Appl. No.: 08/927,412

(22) Filed: Sep. 10, 1997

Related U.S. Application Data

(63) Continuation of application No. 08/502,455, filed on Jul. 14, 1995, now abandoned.

(30) Foreign Application Priority Data

Jul. 14, 1994 (CH) ..... 2248/94

(51) Int. Cl.[7] ..... B26F 3/02

(52) U.S. Cl. ..... 225/97; 225/103; 83/620; 83/699.31

(58) Field of Search ..... 225/97, 103; 83/103, 83/132, 139, 142, 387, 389, 620, 699.31

(56) References Cited

U.S. PATENT DOCUMENTS

| | | | |
|---|---|---|---|
| 1,981,974 | 11/1934 | Vernimb | 493/373 |
| 2,413,999 | 1/1947 | Shaner | 83/103 |
| 3,249,272 | 5/1966 | Scarpa | 225/1 |
| 3,568,903 * | 3/1971 | Lang | 83/103 X |
| 4,175,686 | 11/1979 | Lang | 225/97 |
| 4,546,683 * | 10/1985 | Völkel | 83/103 X |
| 5,192,011 | 3/1993 | Fuchs | 225/97 |
| 5,292,047 | 3/1994 | Varidel | 225/97 |
| 5,353,978 | 10/1994 | Varidel et al. | 225/97 |

FOREIGN PATENT DOCUMENTS

| | | |
|---|---|---|
| 682 651 | 10/1993 | (CH) . |
| 19 23 504 | 11/1969 | (DE) . |
| 0 323 097 | 9/1989 | (EP) . |
| 0 453 982 | 10/1991 | (EP) . |
| 606747 | 8/1948 | (GB) . |

* cited by examiner

*Primary Examiner*—Boyer Ashley

(57) ABSTRACT

A movable upper tool for separating blanks comprises a base plate with apertures and on a lower side is provided with punches. The tool cooperates with a lower tool having separating bars for the separation of the blanks. The apertures of the upper tool are arranged along two orthogonal axes in an area, and one of these orthogonal axes consists of a line slanting with regard to one of the edges of the base plate of the movable tool, and at least one of the lateral sides of each of the cross sections of the punches is tangential to one of the apertures so that the space between the punches determines the total pressure identical to the punches on the blanks to be separated in the neighborhood of the separating bar, regardless of the position of the separating bar of the lower tool.

14 Claims, 4 Drawing Sheets

MOVABLE TOOL FOR SEPARATING BLANKS FROM A SHEET OF DIE-CUT BLANKS

This is a continuation of application No. 08/502,455, filed Jul. 14, 1995, now abandoned.

BACKGROUND OF THE INVENTION

The present invention is directed to a movable upper tool for the separation of die-cut blanks from a sheet which has been processed in a press that manufactures package blanks, particularly a press that manufactures corrugated cardboard blanks from a sheet.

A press that manufactures corrugated cardboard package blanks usually includes several successive stations which are in a chronological order starting with a feeding station, a die-cutting station, a waste-stripping station and a blank-separating and delivery station. In such a machine, the sheet of corrugated cardboard is introduced from the feeding station and is gripped by grippers of a conventional device which consists of a gripper bar mounted at its ends on two chain conveyors that are on the lateral sides of the frame of the machine. The sheet of corrugated cardboard, which is held in the grippers of the gripper bar, is then carried sequentially through the above-mentioned stations with a dwell at each station. With the first standstill or dwell, the sheets will be die-cut by the die-cutting station in order to die-cut blanks in the sheet, which blanks are connected to one another by bridges called nicks. Then, at a second standstill, the die-cut sheet will have waste bits removed from the sheet and, in the third station and standstill, the blanks will be separated from one another and piled up in a separating and delivery station.

With the waste bits having been removed from the sheet of corrugated cardboard in the waste-stripping station, the sheet free of waste will be carried into the blank-separating and delivery station, where the blanks will be separated from one another owing to a movement identical to the one used in the waste-stripping station.

In the known way of using a movable upper tool and a fixed lower tool in a blank-separating station, the upper tool will consist of an assembly of punches and the lower tool will consist of a matrix with apertures corresponding to the size of the blanks. The movable upper punches will push the blanks through the apertures of the lower matrix, which action causes the breaking of the various bridges which interconnect the blanks to one another. Separating tools have to be adjusted to the shape and to the disposition of the blanks of every new series of sheets to be processed. Generally, the punches are fitted in alignment with the trim-lines of the press on a base plate fixed to a movable upper tool-carrier frame of the blank-separating station. Underneath and opposite every punch is arranged a corresponding aperture or opening of a lower matrix which consist of little bars. The little bars are arranged in an overlapping manner in order to make up a grid or matrix whose openings have approximately the same dimensions as the blanks to be separated.

In order to avoid the necessity of manufacturing new tools for the separation of blanks with every new pattern of die-cut blanks in a sheet, U.S. Pat. No. 4,175,686, whose disclosure is incorporated herein by reference thereto and which claims priority from the Swiss Application resulting in Swiss Patent 617 886, suggests the mounting of punches horizontally shiftable along bars fitted on a frame which is vertically movable. Every punch has the shape of a block and is connected to its neighbor by means of a telescopic connection. A fixed lower matrix consists of interconnected bars which are shiftable so as to form a grid whose meshes or openings have adjustable dimensions to correspond to the particular blank being processed.

Another way of realizing the movable upper tool consists in using a plate provided with through-bushings in which are arranged self-locking pins which enable the fastening of punches which are designed to push the blanks to be separated through corresponding apertures in the lower tool. This solution is disclosed in U.S. Pat. No. 5,192,011, whose disclosure is incorporated herein by reference thereto, and also by Swiss Patent No. 681 874.

A third way of realizing a movable upper tool consists in using a plate with a great number of apertures, and on a lower side of the plate are mounted rigid punches for the separation of the blanks. These punches are fitted on the plate by self-adhesive strips. This is disclosed in U.S. Pat. No. 5,353,978, whose disclosure is incorporated herein by reference thereto, and by Swiss Patent 682 651.

As mentioned in U.S. Pat. No. 5,353,978, it is necessary that the movable upper tools be made in such a way that the tools allow passage for air during a vertical movement of the tool. For example, numerous apertures are in the plate which make up these tools.

This manner of obtaining the separating blocks requires a construction of a new tool, specifically for each blank configuration on the sheet and independent of the price and time implied in the realization of this new tool. An important storage space must also be incorporated for storing the various tools or punches, since they may be used in subsequent runs at a later date.

Thus, the blank-separating tools, which have just been described, have all the drawbacks of necessitating a rather long preparation, depending on every different run to be achieved by the machine. These operations diminish the performance of the machine when it is necessary to treat numerous different runs in the same working day and augments the downtime during which the machine is inoperative. Consequently, the problem to be solved consists in increasing the effective production of the machine which will manufacture the blanks for forming packages.

SUMMARY OF THE INVENTION

The object of the present invention consists in overcoming the above-mentioned drawbacks inherent in the existing blank-separating tools. This aim is achieved by an improvement in an upper blank-separating tool which includes a movable upper tool for the separation of the blanks from the sheet which is processed by a press that manufactures package blanks, said upper tool including a base plate with apertures and, on a lower side, is provided with punches which cooperate with a lower tool for a separating of the blanks. The improvements are that the apertures in an area are arranged along two orthogonal axes, one of these orthogonal axes consisting of a line slanting with regard to one edge of the base plate of the movable upper tool and by the fact that at least one of the lateral sides of each of the punches extends tangentially to one of the apertures so that the space between the punches determines an identical full pressure of the punch on the blank to be separated in the neighborhood of a separating bar of the lower tool for the separating of blanks, whatever the position occupied by the separating bar of the lower tool may be.

In addition to the above, each of the punches is made of a resilient material so that it may be deformed if it comes in contact with one of the separating bars.

Other advantages and features of the invention will be readily apparent from the following description of the preferred embodiments, the drawings and claims.

DESCRIPTION OF THE PREFERRED EMBODIMENTS

Figure 4:
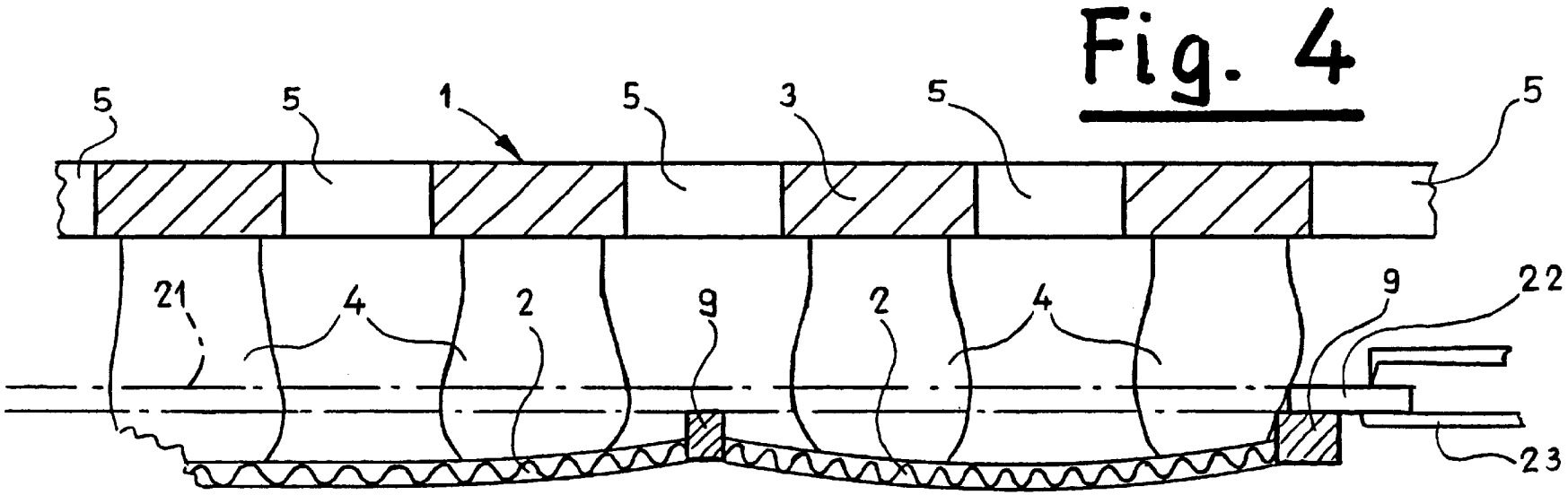
FIG. 4 is a cross sectional view of punches in the phase of separating a blank.

The principles of the present invention are particularly useful when incorporated in an upper tool, generally indicated at 1 in FIG. 4, for separating box blanks 2 from a sheet 21 of die-cut blanks.

Figure 1:
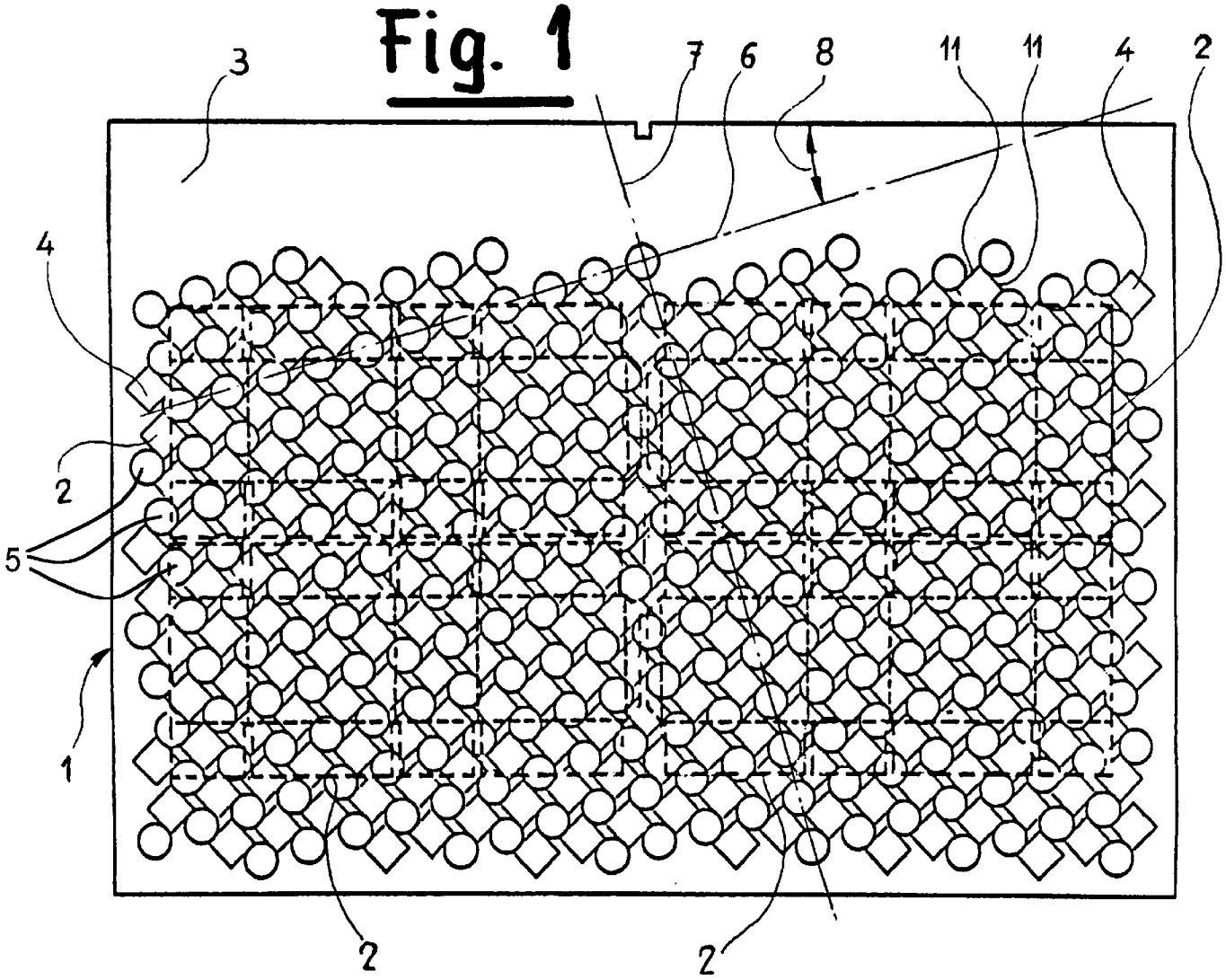
FIG. 1 is a plan view of a first version of an upper tool.

As best illustrated in the version of FIG. 1, the upper tool 1 consists of a base plate 3, which is generally constructed of wood or a synthetic material, and of punches 4 which have a parallelepiped shape and which are glued on a lower side of the base plate 3. This base plate has a plurality of apertures 5 of a circular shape in the present execution shown in FIG. 1. These apertures cross through the base plate and are to leave a passage for air resulting from the alternate vertical movement of the upper tool 1 relative to the lower tool. The aperture may have any geometrical shape and may consist of square apertures, for instance. The selection of a circular shape has been dictated by considerations of the ease in manufacturing such apertures.

Figure 3:
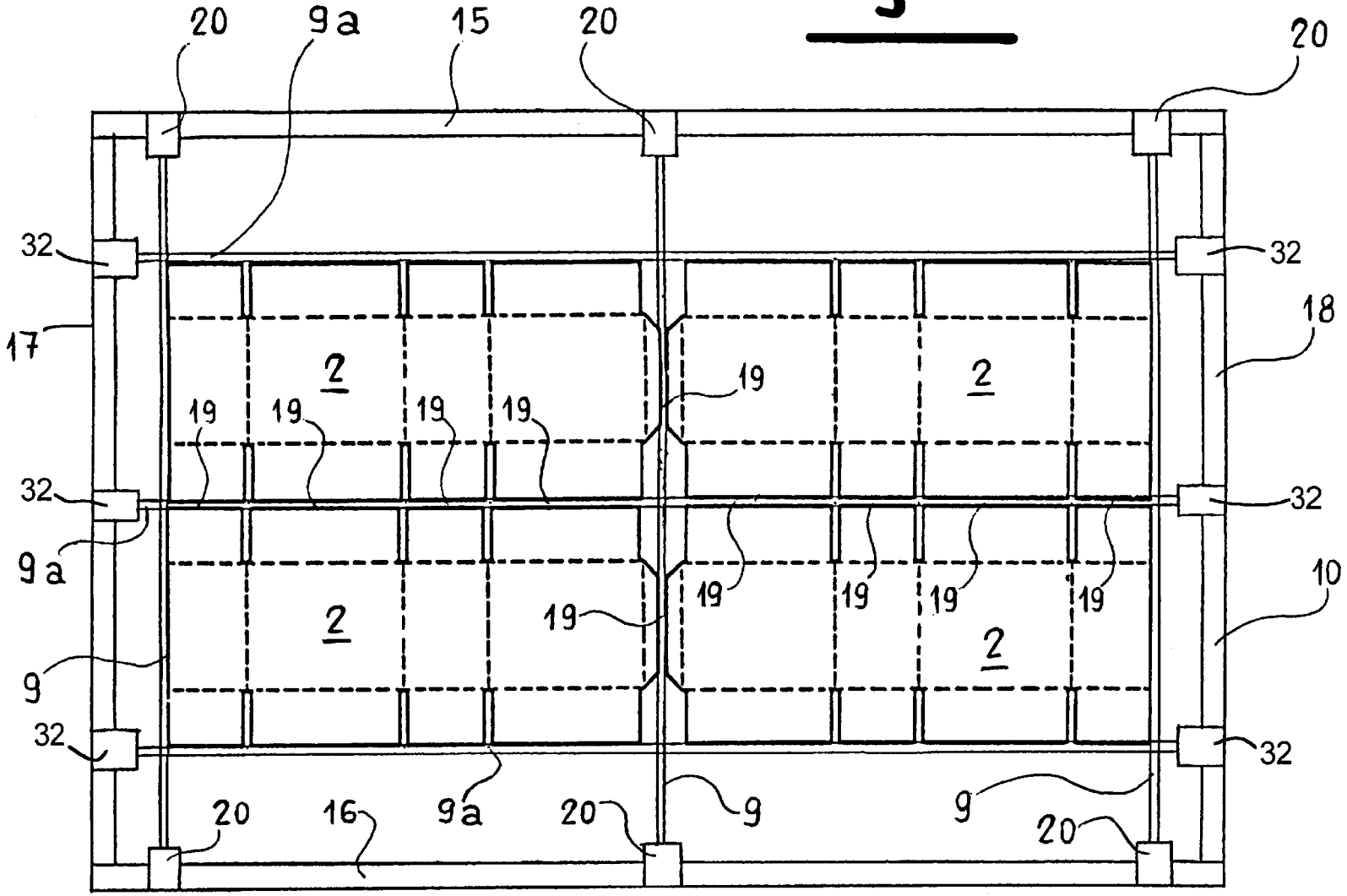
FIG. 3 is a plan view of a lower blank-separating tool.

The apertures 5 are arranged on the base plate 3 in rows and columns which extend along two orthogonal axes 6 and 7, with the axis 6 being made by a slanted line which makes up an angle 8 in a range of between 15° and 20° with regard to one of the edges of the base plate 3. The exact amount of the angle 8 is determined by the dimensions of the aperture 5 and by the dimensions of the punches 4, as well as by the space between the punches 4, so that the regular pressure on the punches will be obtained on the blank 2 to be separated in the neighborhood of the lengthwise and crosswise separating bars 9 and 9a of the lower tool 10, as illustrated in FIG. 3. The punches 4 have a square cross section and are preferably made of a resilient material, such as foam rubber with a density in a range between 30 kilograms and 100 kilograms per cubic meter. In the present example, the density chosen during practical test is for an 80 kilogram per cubic meter. The density choices of the foam rubber depend on the characteristics of the corrugated cardboard to be processed. In the example illustrated herewith, the punches 4 are arranged on the base plate 3 so that each of the four sides 11 of the square cross section of the punch is tangential to an aperture 5. Thus, with this disposition of the various punches 4 on the base plate 3, the total pressure of the punches in the neighborhood of the lengthwise and crosswise separating bars 9 and 9*a* of the lower tool 10 will be regular, whatever the position of the separating bars 9 and 9*a* might be. In the execution represented in FIG. 1, certain punches 4, which are opposite the separating bars 9 and 9*a* of the lower tool, might be relatively deformed, which fact may disturb the functioning of the upper tool 1. In order to overcome this drawback, the punches 4, which are opposite each of the lengthwise and crosswise separating bars 9 and 9*a* of the lower tool 10, can be merely cut for instance by a knife.

Figure 2:
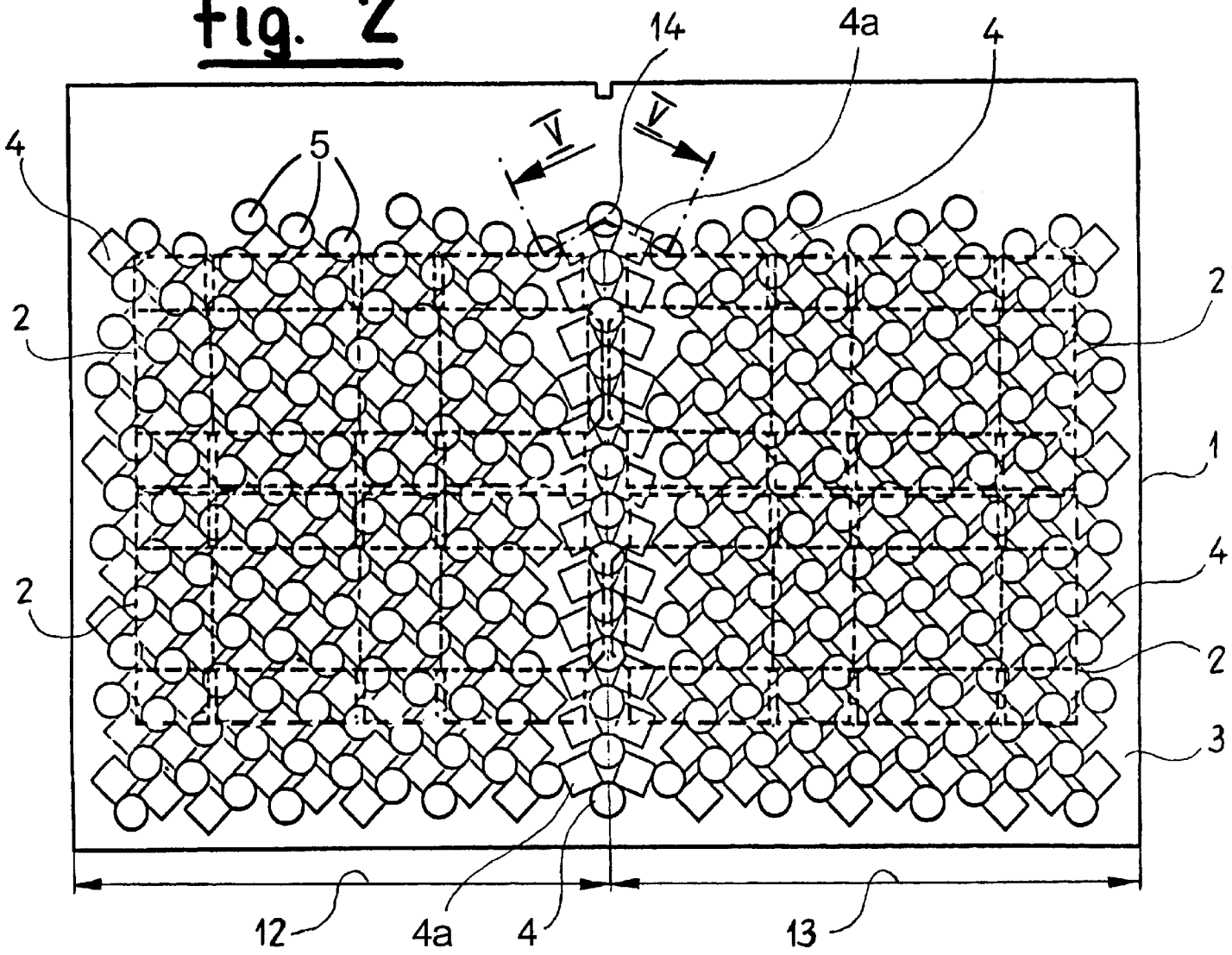
FIG. 2 is a plan view of a second version of the upper tool.

In a second embodiment shown in the version of FIG. 2, the upper tool 1 is illustrated with the punches similar to the one illustrated in FIG. 1. However, due to the fact that the crosswise separating bar 9 situated on the median axis of the lower tool always occupies the same position, one can avoid the cutting of the punches which are in the neighborhood of this middle separating bar 9. To this aim, the upper tool 1 is divided into two areas 12 and 13, which shall include punches 4 arranged in the same manner as those in the upper tool 1 of FIG. 1. The two areas 12 and 13 are separated by a series of punches 4*a* and arranged with certain of their sides tangential and diagonal to the circumference of another set or singular row of circular apertures 14 aligned on the median axis of the tool 1 and to extend perpendicular to the one edge of the plate or tool 1 as shown in FIG. 2. This arrangement, although respecting the condition of the regular pressure on the blanks 2 in the neighborhood of the middle separating bar 9, will avoid the necessity of one cutting operation on the punches 4. It could also be possible to use such a disposition of the punches 4*a* in the neighborhood of the central lengthwise separating bar 9*a* on the condition that the central separating line of the blanks is always centered on this central separating bar 9*a*.

The lower tool 10 for the separating of the blanks 2 is illustrated in FIG. 3. Four blanks 2 are represented in this Figure and are interconnected to one another by bridges, such as 19. The lower tool consists of a frame which includes two longitudinal beams 15 and 16 and two crosswise beams or crossbars 17 and 18. The crosswise separating bars 9 are located between the longitudinal beams 15 and 16 to which they are connected by means of straps 20, which are arranged so as to be shifted and locked in position along the longitudinal beams 15 and 16. The lengthwise separating bars 9*a* are mounted between the crossbars 17 and 18 and are connected by means of straps, such as 32, which are similar to the straps 20 and are arranged to enable shifting and locking the various bars 9*a* in the desired position along the crossbars 17 and 18. The upper tool 1 is arranged above the lower tool 10 and will push, in the course of its descent, the different blanks 2 through the openings made by the crosswise and lengthwise separating bars 9 and 9*a*. The bridges will then be broken and the blanks 2 will be separated from one another. As illustrated, the bridges between the blanks 2 overlie bars, such as 9 and 9*a*.

As illustrated in FIG. 4, the step of separating the blanks 2 is being accomplished with the bridges between the two illustrated blanks being broken. The blanks 2 were originally in the sheet 21, which is shown in dot-dash lines, and have been pushed through the openings formed by the bars 9, which causes breaking of the bridges and separating of the blanks. The pushing is accomplished by the punches 4, which are made of a resilient deformable material, and one notices that even if the punch meets a solid object, such as a separating bar 9, it will achieve a satisfactory separation. As illustrated in FIG. 4, the sheet 21 has a seizing zone 22 at the leading end which is held by the grippers 23, and this leading portion of waste enables transporting the sheet 21 through the various stations and will subsequently be discharged from the grippers after the blanks 2 have been separated from the sheet 21.

Figure 5:
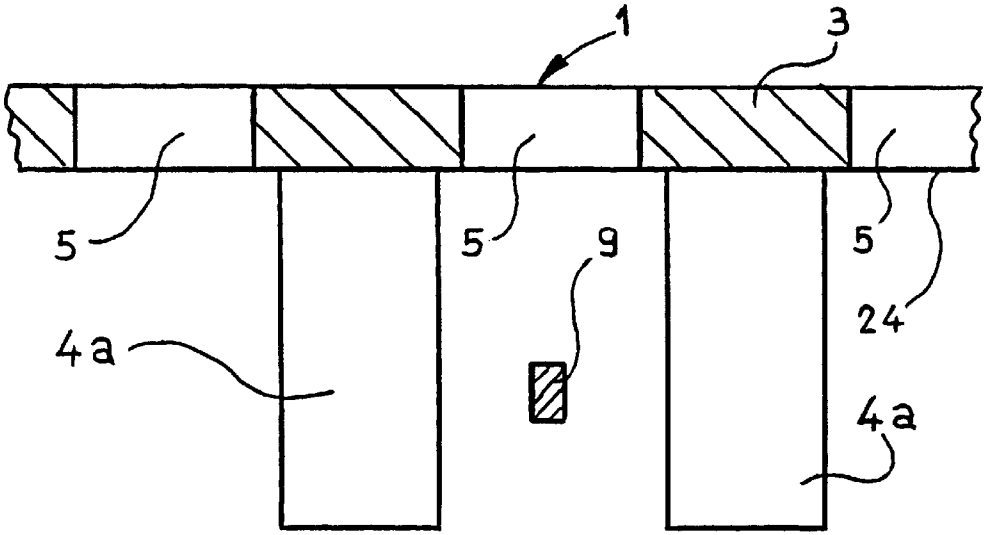
FIG. 5 is a cross sectional view taken along the lines V—V of FIG. 2.

As illustrated in FIGS. 4 and 5, the various punches 4 and 4*a* are mounted on a lower surface, such as 24, of the plate 3. As a general rule, this way of fastening the punches 4 and 4*a* is achieved by gluing, but it can also be imagined to use another permanent fastening method. In the present example, the punches 4 and 4*a* are of a prismatic shape with a square cross section, but one could very well choose a different cross section, such as a polygon or a circular cross section, depending on the practical results obtained with production tests.

As it comes forth in the description, the advantage of using the upper tool 1, such as the one proposed for the present invention, remains in the fact that it is possible to separate blanks of different dimensions with the single and same tool without having to make long and fastidious settings or repositioning of the punches, as was the case with the previously-known conventional separating tools used up to now. Therefore, the time required setting up an operation of the new run is considerably reduced and the production capacity of the machine that manufactures packages is increased with the same rate, because the downtime for setup has been reduced.

Although various minor modifications may be suggested by those versed in the art, it should be understood that we wish to embody within the scope of the patent granted hereon all such modifications as reasonably and properly come within the scope of our contribution to the art.

We claim:

1. In a movable upper tool for separation of blanks from a die-cut sheet which has been processed in a press for manufacturing blanks for packages, said movable upper tool including a rectangular base plate with apertures and, on a lower surface of the plate, the plate having a plurality of punches, said punches cooperating with a lower tool having separating bars for the separation of blanks from the die-cut sheet, the improvements comprising the apertures having a curved edge and being arranged in a pattern of rows and columns extending along two orthogonal axes to form spaces on the lower surface between the apertures, one of said orthogonal axes consisting of a line slanted at an angle of between 15° and 20° with regard to one edge of the rectangular base plate of the movable upper tool and said punches being of a resilient material and secured on the lower surface in rows and columns in said spaces with at least one lateral side of the cross section of each of the punches being tangential to the curved edge of one of the apertures so that the apertures are substantially free of obstruction by the punches and a spacing between punches is constant and provides an identical full pressure of the punches on the blank to be separated in the neighborhood of each separating bar of the lower tool for the separating of blanks, whatever position is occupied by the separating bar of the lower tool.

2. In a movable upper tool according to claim 1, wherein the punches have a parallelepiped shape.

3. In a movable upper tool according to claim 2, wherein the punches are made of foam rubber with a density in a range of between 30 kilograms and 100 kilograms per cubic meter.

4. In a movable upper tool for separation of blanks from a die-cut sheet which has been processed in a press for manufacturing blanks for packages, said movable upper tool including a base plate with apertures and, on a lower surface of the plate, the plate having a plurality of punches, said punches cooperating with a lower tool having separating bars for the separation of blanks from the die-cut sheet, the improvements comprising the apertures being in at least two areas separated by a zone, the apertures in each area having curve edges and being arranged in a pattern of rows and columns extending along a pair of orthogonal axes to form a pattern of spaces on the lower surface between the apertures, one axis of each pair of orthogonal axes consisting of a line slanted at an angle to one edge of the base plate, said punches being of a resilient material and being secured on the lower surface in said spaces with at least one lateral side of the cross section of each punch being in tangential contact with the curved edge of the aperture to form a pattern of punches in rows and columns in each area extending parallel to the rows and columns of apertures so that the apertures of each area are free of obstruction by the punches and a spacing between punches is constant and provides an identical full pressure of the punches on each blank to be separated in a neighborhood of the separating bar of the lower tool for the separation of blanks, whatever position is occupied by the separating bar of the lower tool, said zone including a first row of circular apertures extending at right angles to the one edge and a row of punches on each side of the first row with said punches having two adjacent sides tangentially contacting adjacent circular apertures of the first row.

5. In a movable upper tool according to claim 4, wherein the angle in each area is in a range of between 15° and 20° with regard to the one edge.

6. In a movable upper tool according to claim 5, wherein the punches have a parallelepiped shape.

7. In a movable upper tool according to claim 6, wherein the punches are made of foam rubber with a density in a range of between 30 kilograms and 100 kilograms per cubic meter.

8. In a movable upper tool for separation of blanks from a die-cut sheet which has been processed in a press for manufacturing blanks for packages, said movable upper tool including a base plate having an outline which has a symmetrical axis, said base plate having apertures between which punches are fastened on a lower surface of the plate, said upper tool cooperating with a lower tool having separating bars for the separation of blanks from the die-cut sheet, the improvements comprising said punches being of a resilient material, said punches being arranged along two orthogonal axes with at least one lateral side of a cross section of each punch being in contact with an edge of one of said apertures, one of said orthogonal axes consisting of a line slanted at an angle with regard to an edge of the base plate of the movable upper tool so that said punches are evenly distributed on the base plate and provide a regular pressure on each blank to be separated in a neighborhood of the separating bars of the lower tool for separation of blanks whatever position is occupied by the separating bars of the lower tool.

9. In a movable upper tool according to claim 8, wherein the angle is in a range of between 15° and 20° with regard to the one edge of the base plate of the movable upper tool.

10. In a movable upper tool according to claim 8, wherein the punches have a parallelepiped shape.

11. In a movable upper tool according to claim 10, wherein the punches are made of foam rubber with a density in a range of between 30 kilograms and 100 kilograms per cubic meter.

12. In a movable upper tool according to claim 8, wherein said apertures, which are located directly in a neighborhood of the symmetrical axis of the base plate, are aligned on this axis and tangentially bordered with punches arranged at an angle to and along the symmetrical axis.

13. In a movable upper tool according to claim 12, wherein the angle of said one orthogonal axis is in a range of between 15° and 20°.

14. In a movable upper tool according to claim 13, wherein the punches have a parallelepiped shape and are made of foam rubber with a density of between 30 kilograms and 100 kilograms per cubic meter.

* * * * *